US011905976B2

(12) United States Patent
Peng et al.

(10) Patent No.: US 11,905,976 B2
(45) Date of Patent: Feb. 20, 2024

(54) QUICK NO-WATER STARTUP APPARATUS FOR CENTRIFUGAL PUMP

(71) Applicant: Jiangsu University, Jiangsu (CN)

(72) Inventors: Guangjie Peng, Jiangsu (CN); Shiming Hong, Jiangsu (CN); Hao Chang, Jiangsu (CN); Jialin Du, Jiangsu (CN)

(73) Assignee: Jiangsu University, Jiangsu (CN)

( * ) Notice: Subject to any disclaimer, the term of this patent is extended or adjusted under 35 U.S.C. 154(b) by 0 days.

(21) Appl. No.: 17/787,941

(22) PCT Filed: Aug. 5, 2021

(86) PCT No.: PCT/CN2021/110871
§ 371 (c)(1),
(2) Date: Jun. 22, 2022

(87) PCT Pub. No.: WO2023/284038
PCT Pub. Date: Jan. 19, 2023

(65) Prior Publication Data

US 2023/0265850 A1 Aug. 24, 2023

(30) Foreign Application Priority Data

Jul. 14, 2021 (CN) ..... 202110793833.8

(51) Int. Cl.
*F04D 9/04* (2006.01)
*F04D 1/00* (2006.01)
*F04D 9/02* (2006.01)

(52) U.S. Cl.
CPC ..... *F04D 9/04* (2013.01); *F04D 1/00* (2013.01); *F04D 9/02* (2013.01)

(58) Field of Classification Search
CPC ... F04D 9/02; F04D 9/04; F04D 9/041; F04D 1/00
See application file for complete search history.

(56) References Cited

U.S. PATENT DOCUMENTS 11,480,180 B2 * 10/2022 Li ..... F04D 9/02
11,555,497 B2 * 1/2023 Li ..... F04C 2/3566
(Continued)

FOREIGN PATENT DOCUMENTS

CN 108894992 11/2018
CN 108894992 A * 11/2018 ..... F04D 13/06
(Continued)

OTHER PUBLICATIONS

Combined Search report for Application GB 2209201.9 dated Aug. 10, 2022 (Year: 2022).*
(Continued)

*Primary Examiner* — Topaz L. Elliott
(74) *Attorney, Agent, or Firm* — JCIPRNET

(57) ABSTRACT

A quick no-water startup apparatus for a centrifugal pump includes, from top to bottom in sequence, one-way passages (1), a self-priming chamber housing (41), sliding devices (5), a self-priming chamber (4), chamber partition plates (2) a concave-convex impeller (3), inlet channels (6) connected on two sides of the self-priming chamber (4), a spring device (7) of an upper-side x-shaped gas-liquid separation device, the upper-side x-shaped gas-liquid separation device (8), upper and middle-side gas-liquid separation device connecting shafts (9), a middle-side gas-liquid separation device (10), lower-side backflow-type gas-liquid separation devices (11), v-shaped backflow channels (122), an inverted v-shaped inlet channel (121), and an inlet. The quick no-water startup apparatus of the present invention enables the centrifugal pump to directly enter a normal operating condition after no-water startup, and 36 times of air exhaust can be completed while the concave-convex impeller (3) in the self-priming chamber (4) rotates by a circle in the early stage. Besides, the apparatus is provided with the upper, middle, and lower gas-liquid separation devices to fully
(Continued)

realize separation of gas and liquid, so that gas can be exhausted more quickly and the chamber is filled with water. Therefore, the working efficiency is significantly improved and the operation process is greatly simplified.

7 Claims, 7 Drawing Sheets

(56) References Cited

U.S. PATENT DOCUMENTS

| | | | | |
|---|---|---|---|---|
| 2004/0175279 | A1 | 9/2004 | Ramacciotti | |
| 2022/0120280 | A1* | 4/2022 | Li | F04D 9/043 |
| 2022/0325716 | A1* | 10/2022 | Li | F04D 9/02 |
| 2023/0243355 | A1* | 8/2023 | Peng | F04D 9/02 96/220 |
| 2023/0313801 | A1* | 10/2023 | Li | B01D 19/0036 415/56.1 |

FOREIGN PATENT DOCUMENTS

| | | | | | |
|---|---|---|---|---|---|
| CN | 109578288 | | | 4/2019 | |
| CN | 110397599 | | | 11/2019 | |
| CN | 113107858 | | | 7/2021 | |
| CN | 114151354 | A | * | 3/2022 | |
| CN | 115163501 | A | * | 10/2022 | |
| CN | 116163962 | A | * | 5/2023 | |
| GB | 2605110 | A | * | 9/2022 | F04D 9/04 |
| JP | 2001107884 | | | 4/2001 | |

OTHER PUBLICATIONS

"International Search Report (Form PCT/ISA/210) of PCT/CN2021/110871," dated Apr. 14, 20221, pp. 1-5.

"Written Opinion of the International Searching Authority (Form PCT/ISA/237) of PCT/CN2021/110871," dated Apr. 14, 20221, pp. 1-4.

* cited by examiner

QUICK NO-WATER STARTUP APPARATUS FOR CENTRIFUGAL PUMP

CROSS-REFERENCE TO RELATED APPLICATION

This application is a 371 of international application of PCT application serial no. PCT/CN2021/110871 filed on Aug. 5, 2021 which claims the priority benefit of China application no. 202110793833.8, filed on Jul. 14, 2021. The entirety of each of the above mentioned patent applications is hereby incorporated by reference herein and made a part of this specification.

TECHNICAL FIELD

The present invention belongs to the field of quick no-water startup apparatuses, and in particular, relates to a quick no-water startup apparatus for a centrifugal pump.

DESCRIPTION OF RELATED ART

Centrifugal pumps are widely used in agricultural irrigation, industrial fluid transportation, and other fields. Before a centrifugal pump is started, its chamber is filled with air and the impeller can only force the air in the pump to rotate. The generated centrifugal force is extremely small due to light weight of the air, and the pump cannot deliver water if the air is not expelled. Therefore, the pump needs to be filled with water before startup, and this operation is complex. If an external auxiliary equipment is used for evacuation, the energy consumption is high, a lot of noises are produced, and the startup time is greatly prolonged, which are especially unfavorable for occasions in need of emergency water delivery.

SUMMARY

To eliminate the defects in the prior art, the present invention provides a quick no-water startup apparatus for a centrifugal pump. The apparatus is externally connected to a motor, so that the energy consumption is low, a few noises are produced, and the operation is convenient. The apparatus, through its own structure, can quickly complete the processes of air intake, air exhaust, and filling the chamber with water when the apparatus is started and can seal the water inside after the apparatus stops running, so that the apparatus is always filled with water. The centrifugal pump can directly enter a normal operating condition when it is restarted, the working efficiency is significantly improved, and the operation process is greatly simplified.

The present invention achieves the above objective through the following technical means.

A quick no-water startup apparatus for a centrifugal pump is provided. The apparatus has a symmetrical structure and includes, from top to bottom in sequence, one-way passages, a self-priming chamber housing, sliding devices, a self-priming chamber, chamber partition plates, a concave-convex impeller, inlet channels connected to the self-priming chamber, a spring device of an upper-side x-shaped gas-liquid separation device, the upper-side x-shaped gas-liquid separation device, upper and middle-side gas-liquid separation device connecting shafts, a middle-side gas-liquid separation device, lower-side backflow-type gas-liquid separation devices, v-shaped backflow channels, an inverted v-shaped inlet channel, and an inlet.

The plurality of one-way passages are mounted on the self-priming chamber housing and are symmetrically arranged about a central axis of the quick no-water startup apparatus for the centrifugal pump; a rotating wheel, an upper cover plate, a first spring, a rubber connector, and a one-way passage baffle are arranged on each side of the one-way passage, wherein the upper cover plate is a rotatable cover plate and rotates by means of the rotating wheel, the one-way passage baffle is a fixed plate, the first spring is connected to the upper cover plate and the one-way passage baffle, and the rubber connector is mounted on a top end of the upper cover plate.

A plurality of combinations each including a slideway and one of the sliding devices are arranged on the self-priming chamber housing; each of the sliding devices is provided with an outer cover plate, sliding wheels, a third spring, a near slideway baffle, a far slideway baffle, and a baffle sliding rail, wherein the far slideway baffle slides in the baffle sliding rail, the sliding wheels slide in the slideway and are attached to the outer cover plate and the far slideway baffle, the outer cover plate and the far slideway baffle slide with the sliding wheels, and the near slideway baffle is a fixed baffle and is integrally formed with the baffle sliding rail.

Three chamber partition plates are provided and are fixed in the self-priming chamber, the chamber partition plates divide the self-priming chamber into three cavities, and each of the chamber partition plates is provided with a second spring and a rolling axial bead; the concave-convex impeller is provided with an external drive shaft and an axial bead sliding rail; the external drive shaft is externally connected to a motor and is driven by the motor; the motor rotates forward; the axial bead sliding rail is arranged along a periphery of the concave-convex impeller, and the rolling axial beads at the chamber partition plates run on the axial bead sliding rail.

A one-way passage at the inlet channel is disposed in one of the inlet channels connected to one side of the self-priming chamber, and another one of the inlet channels on the other side of the self-priming chamber has an identical structure.

The spring device of the upper-side x-shaped gas-liquid separation device is disposed between the inlet channels on the two sides; the spring device of the upper-side x-shaped gas-liquid separation device is provided with a smaller sliding device, an upper-side baffle, a fourth spring, and a lower-side baffle, and is provided with a baffle, a sliding rail, and rollers on each side, wherein the upper-side baffle is a fixed baffle; the lower-side baffle is a movable baffle, and the lower-side baffle is tightly joined with the fourth spring and the rollers; the rollers run in the sliding rails, and the sliding rails are arranged in the baffles; the smaller sliding device has an identical structure as the sliding device.

The upper-side x-shaped gas-liquid separation device is in an irregular x shape and is symmetrical about the central axis of the quick no-water startup apparatus for the centrifugal pump; each side of the upper-side x-shaped gas-liquid separation device is provided with an upper-side rotating wheel, an upper-side first-stage impeller, first suction inlets, a first-stage channel, an upper-side second-stage impeller, a spring connecting shaft, a lower-side partition plate, a lower-side rotating shaft, an upper-side arm rod, a second-stage channel, a lower-side first-stage impeller, and a lower-side second-stage impeller, wherein the upper-side arm rod is connected to the upper-side rotating wheel and the rollers of the spring device of the upper-side x-shaped gas-liquid separation device, and is capable of moving up and down;

the upper-side first-stage impeller and the upper-side second-stage impeller are mounted in the upper-side arm rod; the lower-side first-stage impeller and the lower-side second-stage impeller are mounted in the lower-side partition plate and take up a smaller area of the lower-side partition plate; a plurality of the first suction inlets are arranged on the first-stage channel and are symmetrically distributed about a central axis of the first-stage channel; a top end of the first-stage channel is connected to the upper-side first-stage impeller and a bottom end of the first-stage channel is connected to the lower-side first-stage impeller; a plurality of the first suction inlets are arranged on the second-stage channel and are symmetrically distributed about a central axis of the second-stage channel; a top end of the second-stage channel is connected to the upper-side second-stage impeller and a bottom end of the second-stage channel is connected to the lower-side second-stage impeller; the spring connecting shaft is connected to the lower-side baffle; the lower-side partition plate is connected to the lower-side rotating shaft and the spring connecting shaft, and is capable of moving up and down.

The upper and middle-side gas-liquid separation device connecting shafts are symmetrically arranged about the central axis of the quick no-water startup apparatus for the centrifugal pump; an impeller of the upper and middle-side gas-liquid separation device connecting shaft and a spring of the upper and middle-side gas-liquid separation device connecting shaft are sequentially arranged from top to bottom in the upper and middle-side gas-liquid separation device connecting shaft on each side.

The middle-side gas-liquid separation device is provided with a top cover plate, second suction inlets, upper pistons, lower pistons, inlet cavities, a bottom cover plate, bottom cover plate impellers, fixed shaft rods, and wing tips, wherein the upper pistons are connected to the top cover plate and the lower pistons are connected to the bottom cover plate; three inlet cavities are provided and are uniformly distributed between the top cover plate and the bottom cover plate; ten second suction inlets, five on each side, are provided for each of the inlet cavities and are symmetrically distributed about a central axis of the inlet cavity; two bottom cover plate impellers are arranged in the bottom cover plate and are symmetrically distributed about a central axis of the bottom cover plate; the wing tips are on two ends of the bottom cover plate; top ends of the fixed shaft rods are connected to the bottom cover plate and bottom ends of the fixed shaft rods are connected to the lower-side backflow-type gas-liquid separation devices; a fixed shaft rod impeller is arranged in each of the fixed shaft rods.

The lower-side backflow-type gas-liquid separation devices are symmetrically arranged about the central axis of the quick no-water startup apparatus for the centrifugal pump; the lower-side backflow-type gas-liquid separation device on each side is provided with an upper-stage impeller, a lower-stage impeller, an upper-side cover plate, and a lower-side cover plate, wherein an upper-side penetrating cover plate for a fluid to pass therethrough is arranged on the upper-side cover plate and at a position corresponding to the upper-stage impeller; a lower-side penetrating cover plate for a fluid to pass therethrough is arranged on the lower-side cover plate and at a position corresponding to the lower-stage impeller.

Each of the v-shaped backflow channels is provided with springs, rotating wheels, rubber connectors, and cover plates, wherein the cover plates are rotatable cover plates and are rotatable by means of the rotating wheels, the springs are connected to the cover plates, and the rubber connectors are mounted on top ends of the cover plates; the inverted v-shaped inlet channel is provided with the same parts as the v-shaped backflow channels.

Further, every two of the three chamber partition plates form an angle of 120°.

Further, the lower-side partition plates on one side of the upper-side x-shaped gas-liquid separation device divide the interior of the apparatus into an upper chamber where the inlet channels and the other parts are located and a lower chamber where the middle-side gas-liquid separation device and the other parts are located. The lower-side partition plates have good partition capacity.

Further, twelve one-way passages are provided at the self-priming chamber and every three of the one-way passages form a group, the one-way passages are equally disposed on two sides and are symmetrical about the central axis of the quick startup apparatus, and the one-way passages in each group are placed at angles of 15°, 30°, and 45° with the nearby chamber partition plate, respectively.

Further, three sliding devices are provided at the self-priming chamber, and every two of the sliding devices form an angle of 120°. The rotating wheels, the upper-side rotating wheels, the lower-side rotating shafts, the rolling axial beads, the sliding wheels, and the rollers in this patent all have smooth surfaces and produce small friction losses.

Further, air can only be expelled from the self-priming chamber to the outside through the one-way passages at the self-priming chamber housing. The sliding devices and the slideways arranged at the self-priming chamber housing are all sealed. The one-way passages, the one-way passages at the inlet channels, the upper-side x-shaped gas-liquid separation device, the inverted v-shaped inlet channel, and the v-shaped backflow channels in this patent are all provided with the rubber connectors of good sealing performance. Besides, the springs used in this patent have high compressibility and good elasticity.

Further, corresponding positions at the lower-side backflow-type gas-liquid separation devices, the upper-side arm rod and the lower-side partition plate arranged on each side of the upper-side x-shaped gas-liquid separation device, the upper and middle-side gas-liquid separation device connecting shafts, and the bottom cover plate and the impellers in the fixed shaft rods of the middle-side gas-liquid separation device all allow a fluid to pass through and have good penetrating capacity.

Further, the wing tips are provided on two sides of the bottom cover plate at the middle-side gas-liquid separation device, and the wing tips are arranged at positions corresponding to the upper-side penetrating cover plates of the upper-side cover plates.

Further, the upper pistons are initially attached to the lower pistons, and there are no welding joints between the inlet cavities and the top cover plate and between the inlet cavities and the bottom cover plate.

Further, the upper-side gas-liquid separation device is in the irregular x shape and is provided with four rotatable shaft rods; a thickness ratio and a length ratio of the upper-side arm rod to the lower-side partition plate on one side of the upper-side gas-liquid separation device are 1:2 and 1:1.5, respectively and the ratios are the same on the other side of the upper-side gas-liquid separation device.

The present invention has the following beneficial effects.

1. The present invention adopts the one-way passages, so that the gas and the liquid can only be discharged from the apparatus to the outside. The upper cover plates of the one-way passages are provided with the rubber connectors, which improves the sealing performance inside the apparatus. The twelve one-way passages of the same structure are mounted on the self-priming chamber housing, which greatly improves the exhaust capacity of the apparatus.

2. The present invention adopts the combinations of the sliding devices and the slideways, and the rolling axial beads at the chamber partition plates are placed on the axial bead sliding rail along the periphery of the impeller. When the concave-convex impeller in the apparatus rotates, the rolling axial beads at the chamber partition plates move between the convex and concave sections periodically, the springs at the chamber partition plates are stretched periodically, the sliding devices start to slide back and forth periodically, and thus the self-priming chamber expands or contracts periodically. As the volume of the self-priming chamber changes, the internal pressure changes accordingly, and the air in the chamber is expelled through the one-way passages at the self-priming chamber.

3. The present invention adopts the upper-side x-shaped gas-liquid separation device, and through the cooperation of the upper-side and lower-side impellers and the first suction inlets in the channels, air is pushed up layer by layer due to the fact that water is heavier than air. Meanwhile, the impellers arranged in the device can help to realize full separation of gas and liquid. Therefore, the amount of the liquid phase discharged from the apparatus during the self-priming process is reduced and the air exhaust from the apparatus is accelerated, so that the chamber is filled with water more rapidly and the apparatus works more efficiently.

4. The present invention adopts the middle-side gas-liquid separation device, and the upper pistons and the lower pistons cooperate with the second suction inlets and the inlet cavities in the device. As the top cover plate moves up and down periodically, the upper pistons and the lower pistons also move up and down periodically, and the gas-liquid flow enters the inlet cavities from the suction inlets. Gas-liquid separation can be performed layer by layer through multiple layers of the suction inlets and the impellers due to the fact that liquid is heavier than gas. In addition, the wing tips are provided on two sides of the bottom cover plate at the middle-side gas-liquid separation device and are arranged at positions corresponding to the upper-side penetrating cover plates of the upper-side cover plates in the lower-side backflow-type gas-liquid separation devices. The gas-liquid mixture enters the upper-stage and lower-stage impellers in the lower-side backflow-type gas-liquid separation devices through the wing-shaped structures and gas-liquid separation is realized. The gas-liquid separation devices implement gas-liquid separation inside the chamber in the early and middle stages to preliminarily reduce the gas content in the liquid phase.

DESCRIPTION OF THE EMBODIMENTS

The present invention is further described below with reference to the accompanying drawings and specific embodiments, but the protection scope of the present invention is not limited thereto.

Figure 1:
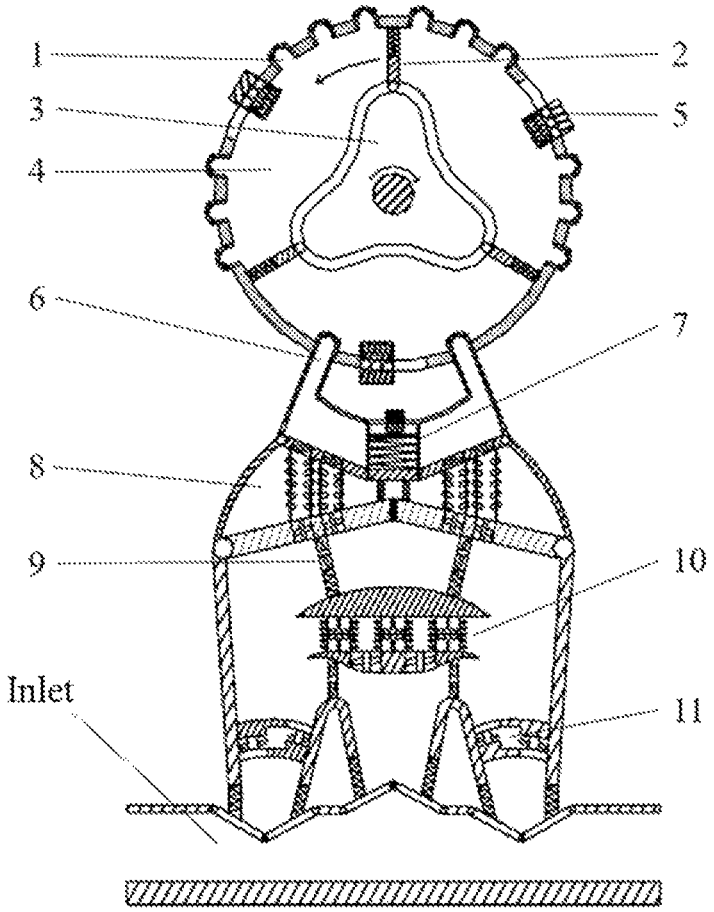
FIG. 1 is a schematic structural diagram of a quick no-water startup apparatus for a centrifugal pump according to the present invention.
Figure 2:
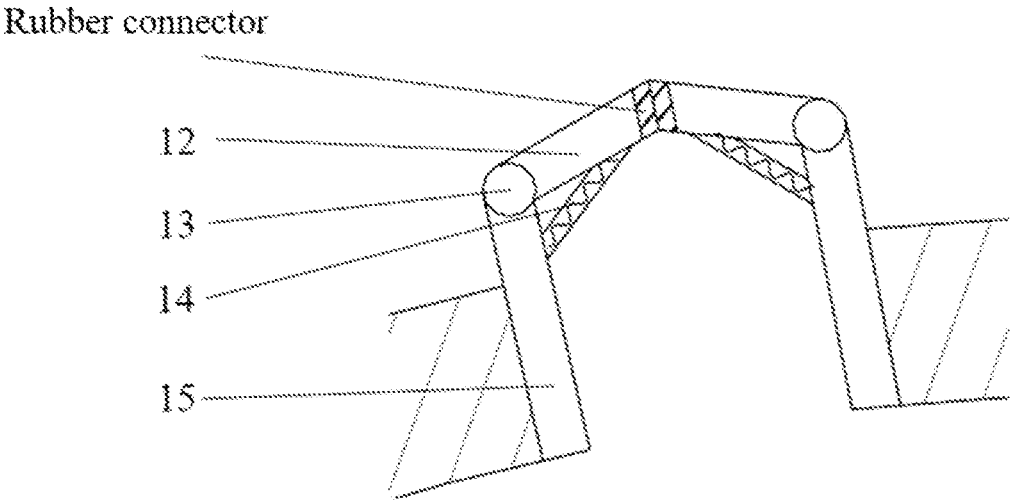
FIG. 2 is an enlarged structural diagram of a one-way passage.
Figure 3:
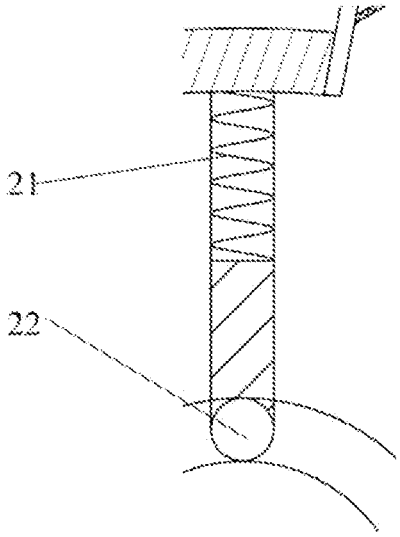
FIG. 3 is an enlarged structural diagram of a chamber partition plate.
Figure 4:
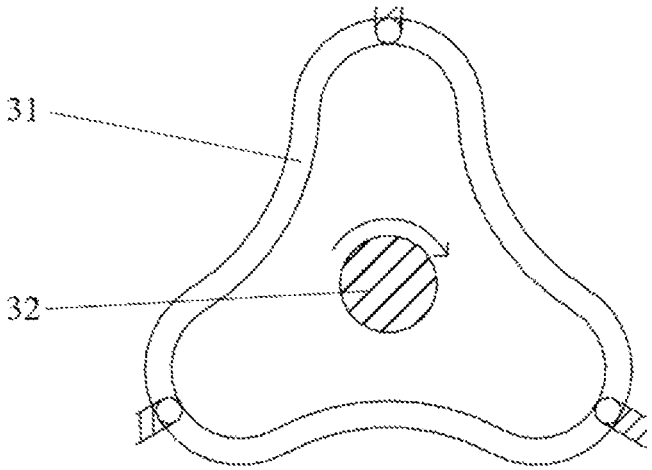
FIG. 4 is an enlarged structural diagram of a concave-convex impeller.
Figure 5:
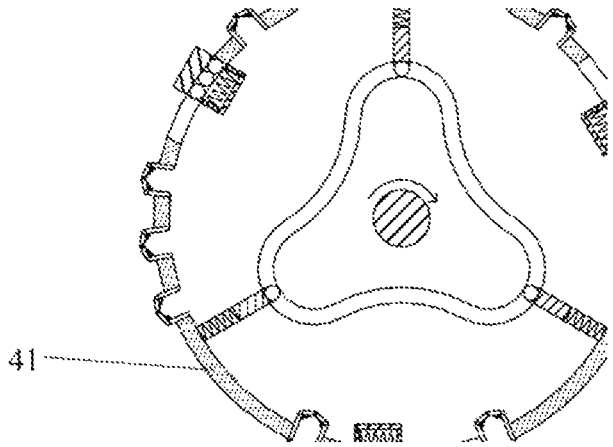
FIG. 5 is an enlarged structural diagram of a self-priming chamber.
Figure 6:
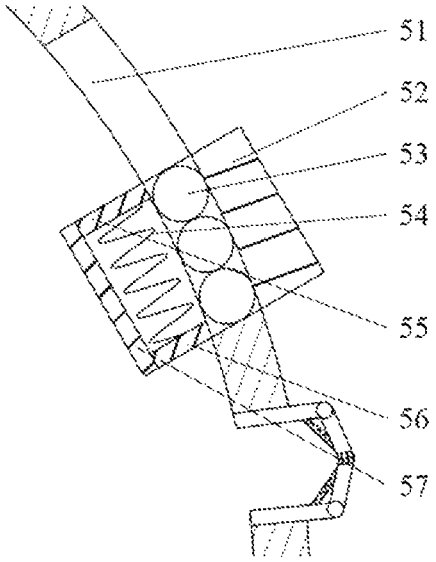
FIG. 6 is an enlarged structural diagram of a sliding device.
Figure 7:
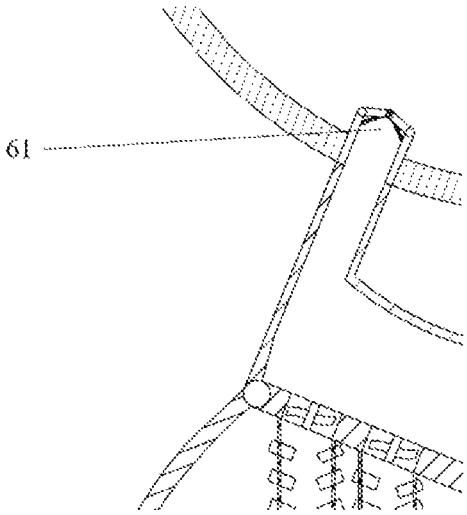
FIG. 7 is an enlarged structural diagram of an inlet channel.
Figure 8:
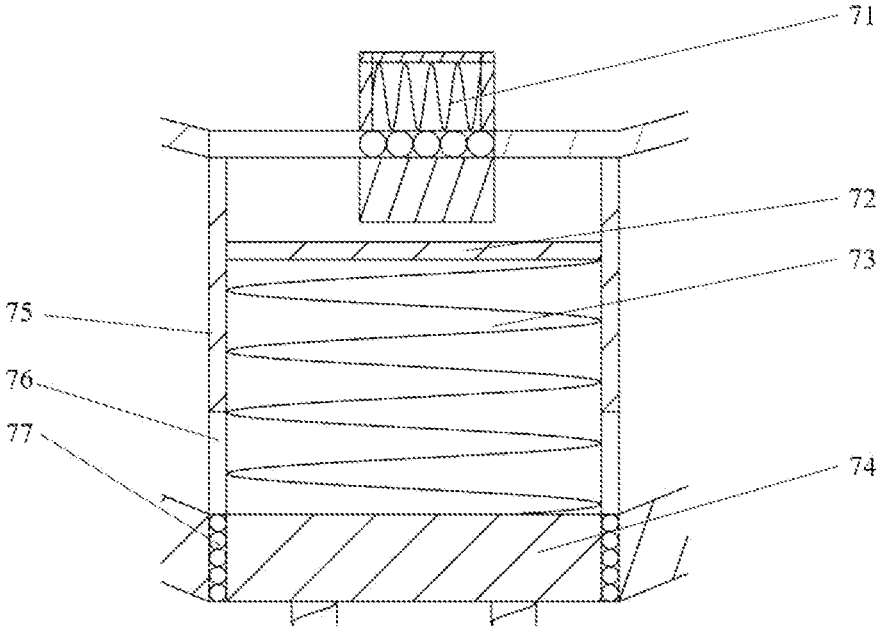
FIG. 8 is an enlarged structural diagram of a spring device of an upper-side x-shaped gas-liquid separation device.
Figure 9:
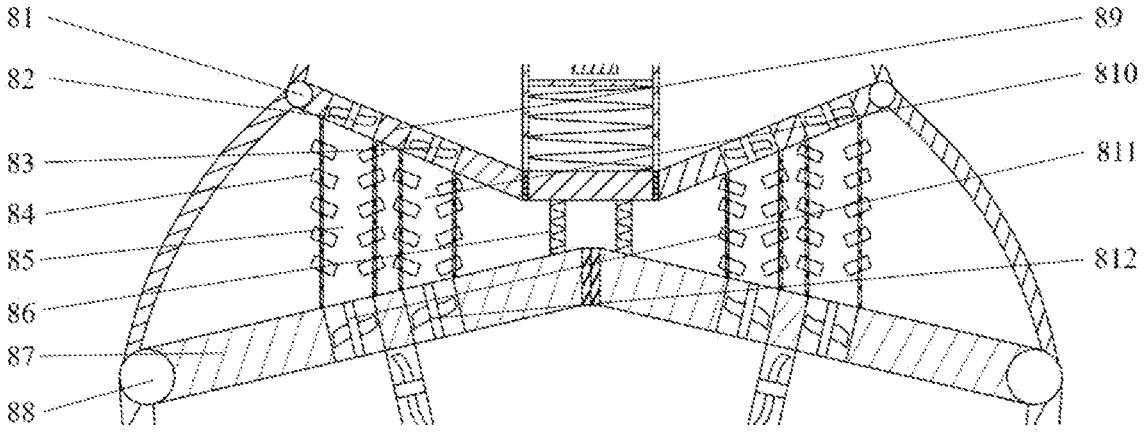
FIG. 9 is an enlarged structural diagram of the upper-side x-shaped gas-liquid separation device.
Figure 10:
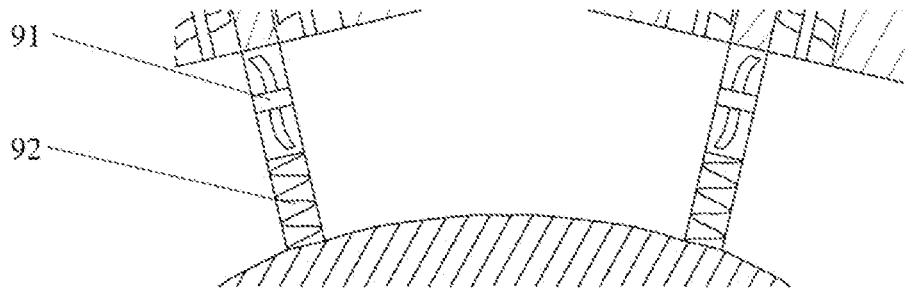
FIG. 10 is an enlarged structural diagram of upper and middle-side gas-liquid separation device connecting shafts.
Figure 11:
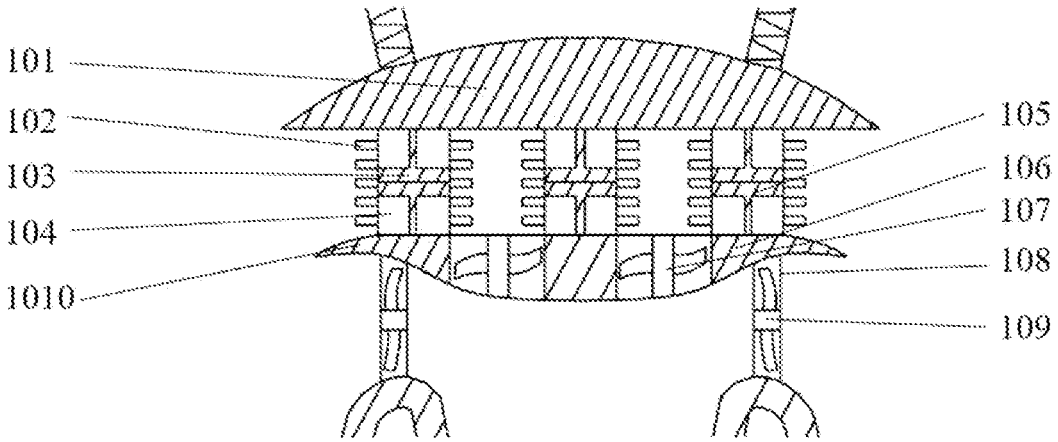
FIG. 11 is an enlarged structural diagram of a middle-side gas-liquid separation device.
Figure 12:
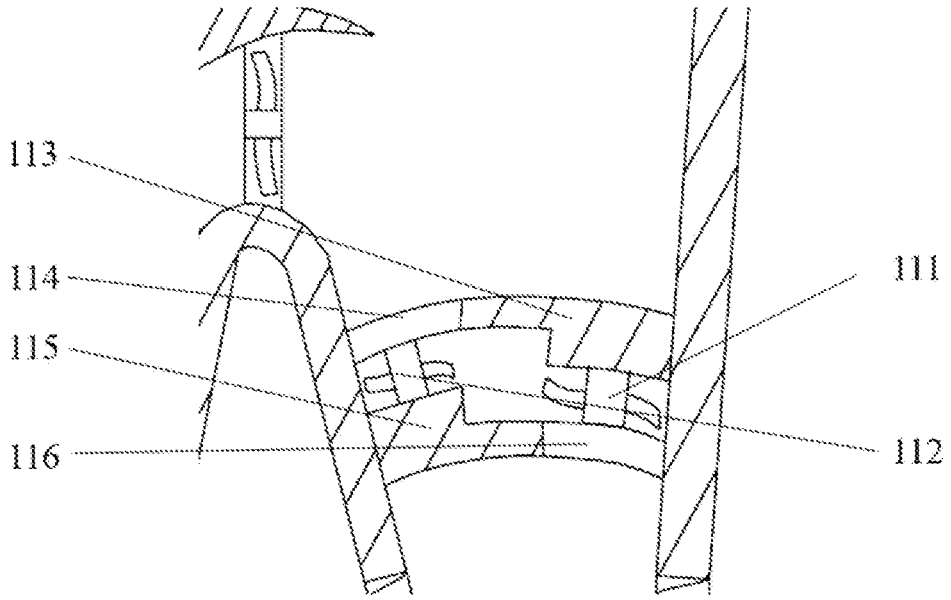
FIG. 12 is an enlarged structural diagram of a lower-side backflow-type gas-liquid separation device.
Figure 13:
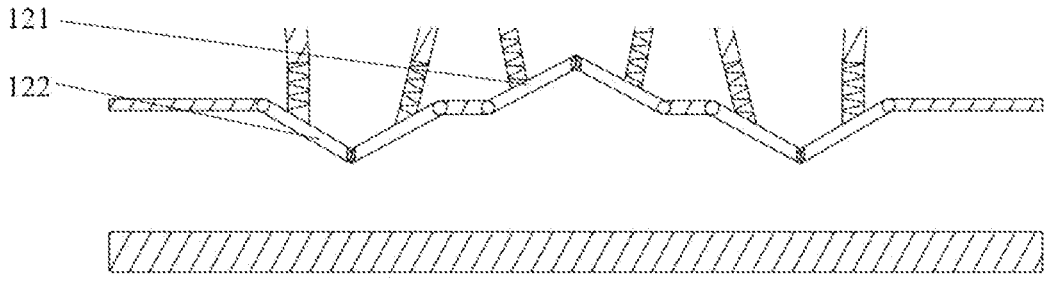
FIG. 13 is an enlarged structural diagram of an inlet.

FIG. 1 shows a quick no-water startup apparatus for a centrifugal pump according to the present invention. The apparatus has a symmetrical structure and includes, from top to bottom in sequence, one-way passages 1, a self-priming chamber housing 41, sliding devices 5, a self-priming chamber 4, chamber partition plates 2, a concave-convex impeller 3, inlet channels 6 connected to the self-priming chamber 4, a spring device 7 of an upper-side x-shaped gas-liquid separation device, the upper-side x-shaped gas-liquid separation device 8, upper and middle-side gas-liquid separation device connecting shafts 9, a middle-side gas-liquid separation device 10, lower-side backflow-type gas-liquid separation devices 11, v-shaped backflow channels 122, an inverted v-shaped inlet channel 121, and an inlet.

The self-priming chamber housing 41 is provided with twelve one-way passages 1, and every three of the one-way passages 1 form a group. The one-way passages 1 are equally disposed on two sides and are symmetrical about a central axis of the quick startup apparatus. The one-way passages 1 in each group are placed at angles of 15°, 30°, and 45° with the nearby chamber partition plate 2, respectively.

The one-way passages 1 are symmetrically arranged about the central axis of the quick no-water startup apparatus for the centrifugal pump. A rotating wheel 13, an upper cover plate 12, a first spring 14, a rubber connector, and a one-way passage baffle 15 are arranged on each side of the one-way passage 1. The upper cover plate 12 is a rotatable cover plate and rotates by means of the rotating wheel 13. The one-way passage baffle 15 is a fixed plate. The first spring 14 is connected to the upper cover plate 12 and the one-way passage baffle 15. The rubber connector is mounted on a top end of the upper cover plate 12.

Three combinations each including a slideway 51 and one of the sliding devices 5 are arranged on the self-priming chamber housing 41, and every two of the sliding devices 5 form an angle of 120°. Each of the sliding devices 5 is provided with an outer cover plate 52, sliding wheels 53, a third spring 54, a near slideway baffle 55, a far slideway baffle 56, and a baffle sliding rail 57. The far slideway baffle 56 slides in the baffle sliding rail 57. The sliding wheels 53 slide in the slideway 51 and are attached to the outer cover plate 52 and the far slideway baffle 56. The outer cover plate 52 and the far slideway baffle 56 slide with the sliding wheels 53. The near slideway baffle 55 is a fixed baffle and is integrally formed with the baffle sliding rail 57.

Three chamber partition plates 2 are arranged, and every two of the chamber partition plates 2 form an angle of 120°. The chamber partition plates 2 are fixed in the self-priming chamber 4 and divide the self-priming chamber 4 into three cavities. Each of the chamber partition plates 2 is provided with a second spring 21 and a rolling axial bead 22. The concave-convex impeller 3 is provided with an external drive shaft 32 and an axial bead sliding rail 31. The external drive shaft 32 is externally connected to a motor and is driven by the motor. The motor rotates forward. The axial bead sliding rail 31 is arranged along the periphery of the concave-convex impeller 3, and the rolling axial beads 22 at the chamber partition plates 2 run on the axial bead sliding rail 31.

A one-way passage 61 at the inlet channel is disposed in one of the inlet channels 6 connected to one side of the self-priming chamber 4, and another one of the inlet channels 6 on the other side of the self-priming chamber 4 has an identical structure.

The spring device 7 of the upper-side x-shaped gas-liquid separation device is disposed between the inlet channels on the two sides. The spring device 7 of the upper-side x-shaped gas-liquid separation device is provided with a smaller sliding device 71, an upper-side baffle 72, a fourth spring 73, and a lower-side baffle 74 and is provided with a baffle 75, a sliding rail 76, and rollers 77 on each side. The upper-side baffle 72 is a fixed baffle. The lower-side baffle 74 is a movable baffle, and the lower-side baffle 74 is tightly joined with the fourth spring 73 and the rollers 77. The rollers 77 run in the sliding rails 76, and the sliding rails 76 are arranged in the baffles 75. The smaller sliding device 71 has an identical structure as the sliding device 5.

The upper-side x-shaped gas-liquid separation device 8 is in the irregular x shape and is symmetrical about the central axis of the quick no-water startup apparatus for the centrifugal pump. Each side of the device is provided with an upper-side rotating wheel 81, an upper-side first-stage impeller 82, first suction inlets 84, a first-stage channel 85, an upper-side second-stage impeller 83, a spring connecting shaft 86, a lower-side partition plate 87, a lower-side rotating shaft 88, an upper-side arm rod 89, a second-stage channel 810, a lower-side first-stage impeller 811, and a lower-side second-stage impeller 812. The upper-side arm rod 89 is connected to the upper-side rotating wheel 81 and the rollers 77 of the spring device 7 of the upper-side x-shaped gas-liquid separation device, and is capable of moving up and down. The upper-side first-stage impeller 82 and the upper-side second-stage impeller 83 are mounted in the upper-side arm rod 89. The lower-side first-stage impeller 811 and the lower-side second-stage impeller 812 are mounted in the lower-side partition plate 87 and take up a small area of the lower-side partition plate 87. A plurality of first suction inlets 84 are arranged on the first-stage channel 85 and are symmetrically distributed about a central axis of the first-stage channel 85. A top end of the first-stage channel 85 is connected to the upper-side first-stage impeller 82 and a bottom end of the first-stage channel 85 is connected to the lower-side first-stage impeller 811. A plurality of first suction inlets 84 are arranged on the second-stage channel 810 and are symmetrically distributed about a central axis of the second-stage channel 810. A top end of the second-stage channel 810 is connected to the upper-side second-stage impeller 83 and a bottom end of the second-stage channel 810 is connected to the lower-side second-stage impeller 812. The spring connecting shaft 86 is connected to the lower-side baffle 74. The lower-side partition plate 87 is connected to the lower-side rotating shaft 88 and the spring connecting shaft 86 and is capable of moving up and down.

The upper and middle-side gas-liquid separation device connecting shafts 9 are symmetrically arranged about the central axis of the quick no-water startup apparatus for the centrifugal pump. An impeller 91 of the upper and middle-side gas-liquid separation device connecting shaft and a spring 92 of the upper and middle-side gas-liquid separation device connecting shaft are sequentially arranged from top to bottom in the upper and middle-side gas-liquid separation device connecting shaft 9 on each side.

The middle-side gas-liquid separation device 10 is provided with a top cover plate 101, second suction inlets 102, upper pistons 103, lower pistons 105, inlet cavities 104, a bottom cover plate 106, bottom cover plate impellers 107, fixed shaft rods 108, and wing tips 1010. The upper pistons 103 are connected to the top cover plate 101. The lower pistons 105 are connected to the bottom cover plate 106. Three inlet cavities 104 are provided and are uniformly distributed between the top cover plate 101 and the bottom cover plate 106. Ten second suction inlets 102, five on each side, are provided for each of the inlet cavities 104 and are symmetrically distributed about a central axis of the inlet cavity 104. Two bottom cover plate impellers 107 are arranged in the bottom cover plate 106 and are symmetrically distributed about a central axis of the bottom cover plate 106. The wing tips 1010 are on two ends of the bottom cover plate 106. Top ends of the fixed shaft rods 108 are connected to the bottom cover plate 106 and bottom ends of the fixed shaft rods 108 are connected to the lower-side backflow-type gas-liquid separation devices 11. A fixed shaft rod impeller 109 is arranged in each of the fixed shaft rods 108.

The lower-side backflow-type gas-liquid separation devices 11 are symmetrically arranged about the central axis of the quick no-water startup apparatus for the centrifugal pump. The lower-side backflow-type gas-liquid separation device 11 on each side is provided with an upper-stage impeller 112, a lower-stage impeller 111, an upper-side cover plate 113, and a lower-side cover plate 115. An upper-side penetrating cover plate 114 for a fluid to pass through is arranged on the upper-side cover plate 113 and at a position corresponding to the upper-stage impeller 112. A lower-side penetrating cover plate 116 for a fluid to pass through is arranged on the lower-side cover plate 115 and at a position corresponding to the lower-stage impeller 111.

Each of the v-shaped backflow channels 122 is provided with springs, rotating wheels, rubber connectors, and cover plates. The cover plates are rotatable cover plates and rotate by means of the rotating wheels, the springs are connected to the cover plates, and the rubber connectors are mounted on top ends of the cover plates. The inverted v-shaped inlet channel 121 is provided with the same parts as the v-shaped backflow channel 122.

Optionally, the lower-side partition plates 87 on one side of the upper-side x-shaped gas-liquid separation device 8 divide the interior of the apparatus into an upper chamber where the inlet channels 6 and the other parts are located and a lower chamber where the middle-side gas-liquid separation device 10 and the other parts are located. The lower-side partition plates 87 have good partition capacity.

The rotating wheels 13, the upper-side rotating wheels 81, the lower-side rotating shafts 88, the rolling axial beads 22, the sliding wheels 53, and the rollers 77 in this patent all have smooth surfaces and produce small friction losses.

Optionally, air can only be expelled from the self-priming chamber 4 to the outside through the one-way passages 1 at the self-priming chamber housing 41. The sliding devices 5 and the slideways 51 arranged at the self-priming chamber housing 41 are all sealed. The one-way passages 1, the one-way passages 61 at the inlet channels, the upper-side x-shaped gas-liquid separation device 8, the inverted v-shaped inlet channel 121, and the v-shaped backflow channels 122 in this patent are all provided with the rubber connectors of good sealing performance. Besides, the springs used in this patent have high compressibility and good elasticity.

Optionally, corresponding positions at the lower-side backflow-type gas-liquid separation devices 11, the upper-side arm rod 89 and the lower-side partition plate 87 arranged on each side of the upper-side x-shaped gas-liquid separation device 8, the upper and middle-side gas-liquid separation device connecting shafts 9, and the bottom cover plate 106 and the impellers in the fixed shaft rods 108 of the middle-side gas-liquid separation device 10 all allow a fluid to pass through and have good penetrating capacity.

Optionally, the wing tips 1010 are provided on two sides of the bottom cover plate 106 at the middle-side gas-liquid separation device 10 and are arranged at positions corresponding to the upper-side penetrating cover plates 114 of the upper-side cover plates 113.

Optionally, the upper pistons 103 are initially attached to the lower pistons 105, and there are no welding joints between the inlet cavities 104 and the top cover plate 101 and between the inlet cavities 104 and the bottom cover plate 106.

Optionally, the upper-side gas-liquid separation device 8 is in the irregular x shape and is provided with four rotatable shaft rods. A thickness ratio and a length ratio of the upper-side arm rod 89 to the lower-side partition plate 87 on one side of the upper-side gas-liquid separation device 8 are 1:2 and 1:1.5, respectively and the ratios are the same on the other side of the upper-side gas-liquid separation device 8.

The working process of the present invention is as follows:

Before the apparatus is started, the rolling axial beads 22 at the chamber partition plates 2 rest on the convex sections of the axial bead sliding rail 31, each of the sliding devices 5 stays at one end of the slideway 51, and the upper cover plates 12 of the one-way passages 1 are all closed. When the concave-convex impeller 3 in the self-priming chamber 4 is driven by the external drive shaft 32 to rotate clockwise, the axial bead sliding rail 31 arranged along the periphery of the concave-convex impeller 3 also rotates with the concave-convex impeller 3, and the rolling axial beads 22 at the chamber partition plates 2 move from the convex sections to the concave sections of the axial bead sliding rail 3. Since the chamber partition plates 2 are fixed in the self-priming chamber 4, the second spring 21 in each of the chamber partition plates 2 is stretched. The sliding devices 5 at the self-priming chamber housing 41 and the smaller sliding device 71 at the spring device 7 of the upper-side x-shaped gas-liquid separation device each start to move from one end of the corresponding slideway 51 to the other end. Therefore, the third spring 54 in each of the sliding devices is compressed. The overall volume of the self-priming chamber 4 is reduced, and the internal pressure is increased accordingly. The initially closed upper cover plates 12 at the one-way passages 1 are immediately opened outward, the first springs 14 at the one-way passages are stretched, and the air is expelled out of the self-priming chamber 4. When the pressure in the self-priming chamber 4 is equal to the external pressure with the discharge of the air from the self-priming chamber 4, the upper cover plates 12 are pulled by the first springs 14 to be closed at once. Due to the existence of the rubber connectors 11, the apparatus is sealed and the outside air cannot enter the self-priming chamber 4. Although the volume of the cavity at the inlet channel 6 connected to each side of the self-priming chamber 4 is reduced, the volume of the self-priming chamber 4 is reduced much more, and the internal pressure in the inlet channel 6 is increased very little, so that the upper cover plates remain closed under the effect of the springs in the one-way passage 61 at the inlet channel 6.

As the concave-convex impeller 3 continues to rotate, the rolling axial beads 22 move from the concave sections to the convex sections of the axial bead sliding rail 31, the sliding devices 5 and the smaller sliding device 71 return to the initial positions, the third springs 54 in the sliding devices 5 and the smaller sliding device 71 return to the initial state from being compressed, the second springs 21 at the chamber partition plates 2 return to the initial state from being stretched, and the self-priming chamber 4 recovers its original volume. During the process that the self-priming chamber 4 with a reduced volume returns to the initial state, since the one-way passages 1 are closed, the self-priming chamber 4 has no air exchange with the outside, and the pressure in the self-priming chamber 4 decreases rapidly, resulting in a large pressure difference between the self-priming chamber 4 and the upper chamber where the inlet channels 6 each connected to one side of the self-priming chamber 4 and the other parts are located. Therefore, the closed upper cover plates of the one-way passages 61 at the inlet channels are opened immediately, air is discharged into the self-priming chamber 4, and the pressure in the upper chamber where the inlet channels 6 each connected to one side of the self-priming chamber 4 and the other parts are located decreases rapidly, resulting in a large pressure difference between the upper chamber and the lower chamber where the middle-side gas-liquid separation device 10 and the other parts are located. Although air can pass through the impellers in the lower-side partition plates 87, the impellers take up a small area of the lower-side partition plates 87, and the pressure balance between the upper and lower chambers cannot be maintained. The lower-side partition plates 87 are opened upward under the pressure difference, and air is discharged into the upper chamber where the inlet channels 6 and the other parts are located. The pressure in the lower chamber where the middle-side gas-liquid separation device 10 and the other parts are located decreases accordingly, and a pressure difference exists between the lower chamber and the outside. Thus, the inverted v-shaped inlet channel 121 is pushed open, water starts to enter the chamber, and the lower-side partition plates 87 return to the initially closed state when pressure balance is achieved between the chamber and the outside.

The above is one operation cycle of the apparatus. At the beginning, due to the small amount of water inflow, pure air is discharged from the self-priming chamber 4. Then, the concave-convex impeller 3 continues to rotate, and the apparatus enters a next operation cycle. When the concave-convex impeller 3 rotates by a circle, the apparatus experiences three operation cycles, and taking the twelve one-way passages into account, 36 times of air exhaust is performed in the self-priming chamber 4 in the early stage.

However, as the impeller continues to rotate, the amount of water inflow gradually increases. When the water flows through the fixed shaft rod impeller 109 in the fixed shaft rod 108, first-stage gas-liquid cutting is carried out. Then, a part of the water flow enters the lower-side backflow-type gas-liquid separation device 11, the upper-stage impeller 112 and the lower-stage impeller 111 carry out second-stage gas-liquid cutting, and air is pushed upward by the incoming water flow. Due to the accumulation of a large amount of water, the v-shaped backflow channel 122 is pushed open, and water flows back into the inlet. The working principle of the other side of the apparatus is similar to the above.

As water continuously enters the chamber, the water flow passes through the middle-side gas-liquid separation device 10 and experiences third-stage gas-liquid cutting by the bottom cover plate impellers 107 in the bottom cover plate 106. The wing tips 1010 on two ends of the bottom cover plate 106 enable a part of the water flow to enter the lower-side backflow-type gas-liquid separation devices 11, and gas-liquid cutting is carried out by the upper-stage impellers 112 and the lower-stage impellers 111. The top cover plate 101 periodically moves up and down with the opening and closing of the lower-side partition plates 87, and the upper pistons 103 and the lower pistons 105 periodically move up and down accordingly. The gas-liquid flow enters the inlet cavities 104 from the second suction inlets 102 and is pushed out of the inlet cavities 104 by the pistons. In this process, the gas is pushed up layer by layer through multiple layers of the second suction inlets 102 due to the fact that liquid is heavier than gas.

As the water level rises, the water flow experiences fourth-stage gas-liquid cutting by the impeller 91 in the upper and middle-side gas-liquid separation device connecting shaft 9. Then, the water flow enters the upper-side x-shaped gas-liquid separation device 8 and experiences fifth-stage separation by the lower-side first-stage impeller 811 and the lower-side second-stage impeller 812. After that, the water flow enters the first-stage channel 85 and the second-stage channel 810. In this process, the gas is pushed up layer by layer through multiple layers of the first suction inlets 84 due to the fact that liquid is heavier than gas. Sixth-stage separation is carried out by the upper-side first-stage impeller 82 and the upper-side second-stage impeller 83. The working principle of the other side of the apparatus is similar to the above.

Till now, very little gas phase is left in the liquid phase. When the water reaches the bottom one-way passages of the self-priming chamber 4, to ensure that no liquid phase is discharged from the chamber, the bottom one-way passages are immediately closed, and the times of air exhaust from the self-priming chamber 4 is reduced. When the water level reaches the middle one-way passages of the self-priming chamber 4, the middle one-way passages are immediately closed, and the times of air exhaust from the self-priming chamber 4 is further reduced. When the water level reaches the top one-way passages of the self-priming chamber 4, the chamber is filled with water. The apparatus can directly enter a normal operating condition when it is restarted, so that the working efficiency is significantly improved.

The above descriptions are preferred embodiments of the present invention, and are not intended to limit the present invention. Any obvious improvements, replacements, or modifications made by persons skilled in the art without departing from the essence of the present invention shall fall within the protection scope of the present invention.

What is claimed is:

1. A quick no-water startup apparatus for a centrifugal pump, wherein the apparatus has a symmetrical structure and comprising, from top to bottom in sequence, a plurality of one-way passages, a self-priming chamber housing, sliding devices, a self-priming chamber, three chamber partition plates, a concave-convex impeller, inlet channels connected to the self-priming chamber, a spring device of an upper-side x-shaped gas-liquid separation device, the upper-side x-shaped gas-liquid separation device, upper and middle-side gas-liquid separation device connecting shafts, a middle-side gas-liquid separation device, lower-side backflow-type gas-liquid separation devices, v-shaped backflow channels, an inverted v-shaped inlet channel, and an inlet;

the plurality of one-way passages are mounted on the self-priming chamber housing and are symmetrically arranged about a central axis of the quick no-water startup apparatus for the centrifugal pump; a rotating wheel, an upper cover plate, a first spring, a rubber connector, and a one-way passage baffle are arranged on each side of the plurality of one-way passages, wherein the upper cover plate is a rotatable cover plate and rotates by the rotating wheel, the one-way passage baffle is a fixed plate, the first spring is connected to the upper cover plate and the one-way passage baffle, and the rubber connector is mounted on a top end of the upper cover plate;

a plurality of combinations each comprising a slideway and one of the sliding devices are arranged on the self-priming chamber housing; each of the sliding devices is provided with an outer cover plate, sliding wheels, a third spring, a near slideway baffle, a far slideway baffle, and a baffle sliding rail, wherein the far slideway baffle slides in the baffle sliding rail, the sliding wheels slide in the slideway and are attached to the outer cover plate and the far slideway baffle, the outer cover plate and the far slideway baffle slide with the sliding wheels, and the near slideway baffle is a fixed baffle and is integrally formed with the baffle sliding rail;

the three chamber partition plates are fixed in the self-priming chamber, the chamber partition plates divide the self-priming chamber into three cavities, and each of the chamber partition plates is provided with a second spring and a rolling axial bead; the concave-convex impeller is provided with an external drive shaft and an axial bead sliding rail; the external drive shaft is externally connected to a motor and is driven by the motor; the motor rotates forward; the axial bead sliding rail is arranged along a periphery of the concave-convex impeller, and the rolling axial beads at the chamber partition plates run on the axial bead sliding rail;

a one-way inlet channel passage is disposed in one of the inlet channels connected to one side of the self-priming chamber, and another one of the inlet channels on the other side of the self-priming chamber has an identical structure;

the spring device of the upper-side x-shaped gas-liquid separation device is disposed between the inlet channels on the two sides; the spring device of the upper-side x-shaped gas-liquid separation device is provided with a smaller sliding device, an upper-side baffle, a fourth spring, and a lower-side baffle, and is provided with an edge baffle, a sliding rail, and rollers on each side, wherein the upper-side baffle is a fixed baffle; the lower-side baffle is a movable baffle, and the lower-side baffle is tightly joined with the fourth spring and the rollers; the rollers run in the sliding rail, and the sliding rail is arranged in the edge baffle; the smaller sliding device has an identical structure as the sliding device;

the upper-side x-shaped gas-liquid separation device is in an irregular x shape and is symmetrical about the central axis of the quick no-water startup apparatus for the centrifugal pump; each side of the upper-side x-shaped gas-liquid separation device is provided with an upper-side rotating wheel, an upper-side first-stage impeller, first suction inlets, a first-stage channel, an upper-side second-stage impeller, a spring connecting shaft, a lower-side partition plate, a lower-side rotating shaft, an upper-side arm rod, a second-stage channel, a lower-side first-stage impeller, and a lower-side second-stage impeller, wherein the upper-side arm rod is connected to the upper-side rotating wheel and the rollers of the spring device of the upper-side x-shaped gas-liquid separation device, and is capable of moving up and down; the upper-side first-stage impeller and the upper-side second-stage impeller are mounted in the upper-side arm rod; the lower-side first-stage impeller and the lower-side second-stage impeller are mounted in the lower-side partition plate; a plurality of the first suction inlets are arranged on the first-stage channel and are symmetrically distributed about a central axis of the first-stage channel; a top end of the first-stage channel is connected to the upper-side first-stage impeller and a bottom end of the first-stage channel is connected to the lower-side first-stage impeller; a plurality of the first suction inlets are arranged on the second-stage channel and are symmetrically distributed about a central axis of the second-stage channel; a top end of the second-stage channel is connected to the upper-side second-stage impeller and a bottom end of the second-stage channel is connected to the lower-side second-stage impeller; the spring connecting shaft is connected to the lower-side baffle; the lower-side partition plate is connected to the lower-side rotating shaft and the spring connecting shaft, and is capable of moving up and down;

the upper and middle-side gas-liquid separation device connecting shafts are symmetrically arranged about the central axis of the quick no-water startup apparatus for the centrifugal pump; an impeller and a spring are sequentially arranged from top to bottom in each upper and middle-side gas-liquid separation device connecting shaft;

the middle-side gas-liquid separation device is provided with a top cover plate, second suction inlets, upper pistons, lower pistons, three inlet cavities, a bottom cover plate, two bottom cover plate impellers, fixed shaft rods, and wing tips, wherein the upper pistons are connected to the top cover plate and the lower pistons are connected to the bottom cover plate; the three inlet cavities are uniformly distributed in a space between the top cover plate and the bottom cover plate; ten second suction inlets, five on each side, are provided for each of the inlet cavities and are symmetrically distributed about a central axis of the inlet cavity; the two bottom cover plate impellers are arranged in the bottom cover plate and are symmetrically distributed about a central axis of the bottom cover plate; the wing tips are on two ends of the bottom cover plate; top ends of the fixed shaft rods are connected to the bottom cover plate and bottom ends of the fixed shaft rods are connected to the lower-side backflow-type gas-liquid separation devices; a fixed shaft rod impeller is arranged in each of the fixed shaft rods;

the lower-side backflow-type gas-liquid separation devices are symmetrically arranged about the central axis of the quick no-water startup apparatus for the centrifugal pump; each lower-side backflow-type gas-liquid separation device is provided with an upper-stage impeller, a lower-stage impeller, an upper-side cover plate, and a lower-side cover plate, wherein an upper-side penetrating cover plate for a fluid to pass therethrough is arranged on the upper-side cover plate and at a position corresponding to the upper-stage impeller; a lower-side penetrating cover plate for a fluid to pass therethrough is arranged on the lower-side cover plate and at a position corresponding to the lower-stage impeller;

each of the v-shaped backflow channels and the v-shaped inlet channel is provided with springs, backflow channel rotating wheels, backflow channel rubber connectors, and backflow channel cover plates, wherein the backflow channel cover plates are rotatable cover plates and are rotatable by the backflow channel rotating wheels, the springs are connected to the backflow channel cover plates, and the backflow channel rubber connectors are mounted on top ends of the backflow channel cover plates.

2. The quick no-water startup apparatus for the centrifugal pump according to claim 1, wherein every two of the three chamber partition plates form an angle of 120°.

3. The quick no-water startup apparatus for the centrifugal pump according to claim 1, wherein the plurality of one-way passages consists of twelve one-way passages provided at the self-priming chamber and sets of three adjacent ones of the one-way passages form a group, the plurality of one-way passages are equally disposed on two sides and are symmetrical about the central axis of the quick startup apparatus, and the one-way passages in each group are placed at angles of 15°, 30°, and 45° with the nearby chamber partition plates, respectively.

4. The quick no-water startup apparatus for the centrifugal pump according to claim 1, wherein the sliding devices provided at the self-priming chamber consist of three sliding devices, and every two of the three sliding devices form an angle of 120°.

5. The quick no-water startup apparatus for the centrifugal pump according to claim 1, wherein the wing tips are provided on two sides of the bottom cover plate at the middle-side gas-liquid separation device, and the wing tips are arranged at positions corresponding to the upper-side penetrating cover plates of the upper-side cover plates.

6. The quick no-water startup apparatus for the centrifugal pump according to claim 1, wherein the upper pistons are initially attached to the lower pistons, and no welding joints are disposed between the inlet cavities and the top cover plate and between the inlet cavities and the bottom cover plate.

7. The quick no-water startup apparatus for the centrifugal pump according to claim 1, wherein the upper-side gas-liquid separation device is in the irregular x shape and is provided with four rotatable shaft rods; in an axial direction along the central axis of the quick no-water startup apparatus, the upper-side arm rod is less thick than the lower-side partition plate, and perpendicular to the axial direction, the upper-side arm rod is shorter than the lower-side partition plate.

* * * * *